US008918963B2

(12) United States Patent
Godoy

(10) Patent No.: US 8,918,963 B2
(45) Date of Patent: Dec. 30, 2014

(54) REVERSIBLE CONNECTION DEVICE BETWEEN A CASING FOR LEAD WEIGHTS AND THE CORRESPONDING POCKET OF A DIVING JACKET

(75) Inventor: Carlos Alberto Godoy, Genoa (IT)

(73) Assignee: Cressi-Sub S.p.A. (IT)

( * ) Notice: Subject to any disclaimer, the term of this patent is extended or adjusted under 35 U.S.C. 154(b) by 131 days.

(21) Appl. No.: 13/615,414

(22) Filed: Sep. 13, 2012

(65) Prior Publication Data

US 2013/0067691 A1 Mar. 21, 2013

(30) Foreign Application Priority Data

Sep. 21, 2011 (IT) ..... FI20110053 U

(51) Int. Cl.
*A41F 1/00* (2006.01)
*A44B 11/25* (2006.01)
*B63C 11/30* (2006.01)

(52) U.S. Cl.
CPC ..... *B63C 11/30* (2013.01); *A44B 11/2592* (2013.01); *B63C 2011/306* (2013.01)
USPC ..... 24/3.1; 24/614; 24/615; 24/616

(58) Field of Classification Search
CPC ..... B63C 11/30; B63C 2011/306; A44B 11/2573; A44B 11/2592
USPC ..... 24/3.1, 323, 614, 615, 616; 405/186
See application file for complete search history.

(56) References Cited

U.S. PATENT DOCUMENTS

| | | | | |
|---|---|---|---|---|
| 4,831,694 | A | 5/1989 | Kong | |
| 6,154,936 | A * | 12/2000 | Howell et al. | 24/625 |
| 6,487,761 | B2 | 12/2002 | Van Tassel | |
| 7,540,691 | B2 * | 6/2009 | Godoy | 405/186 |

FOREIGN PATENT DOCUMENTS

| | | |
|---|---|---|
| EP | 1864586 | 12/2007 |
| IT | 1361976 | 11/2005 |

* cited by examiner

*Primary Examiner* — Robert J Sandy
*Assistant Examiner* — Louis Mercado
(74) *Attorney, Agent, or Firm* — Steinfl & Bruno LLP

(57) ABSTRACT

A device for reversible connection between a casing for lead weights and a corresponding pocket of a diving jacket is described. The device has an elastically insertable and releasable buckle with a male part connected to the casing through a rigid plate and with a sheath, acting as the female part of the buckle, connected to the pocket of the jacket. The rigid plate presents lateral guide ribbings, suitable for facilitating insertion of the male part of the buckle in the sheath.

3 Claims, 5 Drawing Sheets

REVERSIBLE CONNECTION DEVICE BETWEEN A CASING FOR LEAD WEIGHTS AND THE CORRESPONDING POCKET OF A DIVING JACKET

CROSS REFERENCE TO RELATED APPLICATIONS

The present application claims priority to Italian utility model application FI2011U000053 filed on Sep. 21, 2011, which is incorporated herein by reference in its entirety.

FIELD

The present disclosure relates to accessories for diving activities. In particular, it relates to a device for reversible connection between a casing for weights and a corresponding pocket of a diving jacket.

BACKGROUND

Together with suit, mask and fins, a jacket is also used for deep diving activities. The jacket has pockets where various tools to be used by a diver can be arranged.

Such tools include weights, generally made of lead and generally arranged into casings, which weights are intended to cancel out or reverse a difference between hydrostatic thrust of the body and the diving suit on one side, and the corresponding weight on the other side.

The pockets of the jacket are generally provided with a sealing or locking arrangement. If such jackets are intended to contain weights, such arrangement is provided in part on the pocket of the jacket and in part on the casing of the weights, to facilitate insertion and extraction of the casing.

A widely used sealing arrangement includes a buckle with elastic snap engagement and release properties, such as the buckles known as FAST® buckles. Such buckles generally include a male part, provided with elastically deformable arms, able to be inserted inside a female part or sheath. The elastically deformable arms comprise transversal stop abutments, suitable for engagement with corresponding transversal stop abutments projecting inside the sheath. In order to open the buckle it is necessary to intentionally press such elastically deformable arms, perpendicularly to their longitudinal direction, to release the stop abutments of the male part from the stop abutments of the sheath. In order to allow such operation, the sheath includes openings that allow the ends of the arms to be pressed, thus releasing the abutments that keep them anchored to the sheath.

In general, the arms and the opposite surfaces of the sheath are so shaped to push the male part of the buckle out from the sheath when the stop abutments of the male part are released from the stop abutments of the female part, thus allowing the arms to go back into their undeformed position. Such type of buckles are known, for example, from FIG. 2 of U.S. Pat. No. 4,831,694, which patent is incorporated herein by reference in its entirety.

However, the diver is often equipped with gloves of substantial thickness. As a consequence, transversal squashing of the deformable arms through suitable slits arranged in the sheath may become difficult. In this respect, in the above mentioned U.S. Pat. No. 4,831,694, the transversal squashing action of the deformable arms is carried out by sliding of a sleeve surrounding the buckle.

Also sliding of the sleeve itself on the buckle can be difficult for the diver, though. In this respect, U.S. Pat. No. 6,487,761, also incorporated herein by reference in its entirety, facilitates the opening of the buckle and allows release of the stop abutments of the deformable arms of the male part from the stop abutments of the female part or sheath, by providing a handgrip connected to the male part of the buckle through a flexible connection arrangement. In particular, by pulling the handgrip, the diver releases the flexible arms of the male part from the stop abutments of the sheath and, continuing such pulling action, also extracts the casing of the weights together with the male part of the buckle.

However, in the above mentioned FAST® buckles, as soon as the ends of the flexible arms are released from the abutments of the sheath, the male part of the buckle is forced to automatically come out of the sheath, thus causing opening of the buckle. Therefore, an accidental knocking of the handgrip against a rock or a rigid body can cause the buckle to open and the casing of the weights to be lost as a consequence.

A further drawback in addition to the one mentioned above occurs when the diver wants to place the casing of the weights back in the pocket immediately after extraction of such casing. Such operation is rather complex when the diver is underwater, as the weights, instead of being a single rigid element (e.g., a parallepiped-shaped element), usually include several loose elements causing deformation of the casing and requiring a hand-guided movement in order to be correctly inserted into the pocket, upon which insertion the male part of the buckle has to be guided into the female part thereof to prevent the casing from accidentally coming out.

In order to overcome the first drawback, Italian patent No. 1,361,976, in the name of the same applicant of the present application and incorporated herein by reference in its entirety, provides for two consecutive voluntary operations in order to open the buckle. In a first step, a locking element is extracted by pulling the handgrip. In a subsequent step, by continuing the pulling action on the handgrip, the male element of the buckle is extracted from the sheath. Therefore, accidental knocking of the handgrip against a rigid body cannot cause an involuntary opening of the buckle with consequent loss of the casing of the weights.

In order to overcome the second drawback, as also provided in the above mentioned Italian patent, the part of the buckle applied to the casing of the weights is arranged on a rigid plate. Such rigid plate facilitates the diver's introduction of the casing in the pocket of the jacket when underwater.

In European patent EP 1,864,586, also in the name of the same applicant of the present application and incorporated herein by reference in its entirety, a buckle with a more compact shape is provided, where involuntary opening is further prevented. According to this patent application, a pulling action exerted on the handgrip initially causes an auxiliary element to slide inside the male element of the buckle, where the male element is provided with inclined surfaces sliding on corresponding inclined surfaces of the deformable arms of the male element, deforming such arms to release their stop surfaces from the stop surfaces of the female part.

Therefore, by pulling the handgrip connected to the male part of the buckle, a progressive sliding of such inclined surfaces occurs, with a consequent bending of the deformable arms, until release of the transversal abutment surfaces on the deformable arms from the corresponding transversal abutment surfaces of the sheath, so that the casing of the weights can be extracted from the pocket of the jacket.

It should be noted that interruption of the pulling action on the handgrip during the mutual sliding step of the inclined surfaces causes the elasticity of the deformable arms to invert the sliding movement, thus bringing the buckle back into the starting closed position. In such way, accidental knocking is prevented from opening the buckle.

It should also be noted that, when the diver is underwater, inserting a previously extracted casing of the weights into the pocket of the jacket is complicated by the fact that the pocket generally has a larger cross section than that of the casing, so that several attempts may be needed before a correct insertion of the male part in the sheath occurs, both the male part and the sheath being smaller than the pocket in cross section.

SUMMARY

Embodiments of the present disclosure provide a device for reversible connection between a casing for weights (e.g., lead weights) and a corresponding pocket of a diving jacket, suitable for facilitating insertion of the casing of the weights in the pocket of the jacket when the diver is submerged.

In particular, embodiments of the present disclosure provide a connection device that is being kept closed even in presence of an accidental knock on the handle, thus requiring a voluntary action of a predetermined spatial extent by the operator in order to open the device.

According to an aspect of the present disclosure, a device for reversible connection between a casing for weights and a corresponding pocket of a diving jacket is disclosed, comprising: an elastically insertable and releasable buckle comprising: a male part comprising elastically deformable arms, with transversal abutment surfaces and inclined sliding sides, a rigid plate connecting the male part to the casing, the rigid plate comprising lateral guide ribbings, a sheath acting as a female part of the buckle, the sheath comprising transversal abutment surfaces and being connected to the pocket of the diving jacket, wherein the lateral guide ribbings are suitable for insertion of the male part in the sheath, and an auxiliary element slidably engaged on the rigid plate, the auxiliary element being suitable for bending the deformable arms in order to release the transversal abutment surfaces of the deformable arms from the transversal abutment surfaces of the sheath, the auxiliary element comprising a handgrip.

According to a further embodiment, the guide ribbings are wide at the entry end and narrower at the other end. In such way, the male part of the buckle is guided into a correct engagement position of the female part, thus facilitating insertion of the casing of the weights in the pocket of the jacket.

According to another embodiment, the configuration of the buckle allows both insertion of the casing of the weights into the pocket and of the male element in the sheath to be carried out with a single manoeuvre, at the end of which the buckle is automatically closed.

BRIEF DESCRIPTION OF THE DRAWINGS

The present disclosure will now be illustrated in greater detail in the following description of embodiments thereof given as non-limiting examples with reference to the attached drawings, in which.

DETAILED DESCRIPTION

Figure 1:
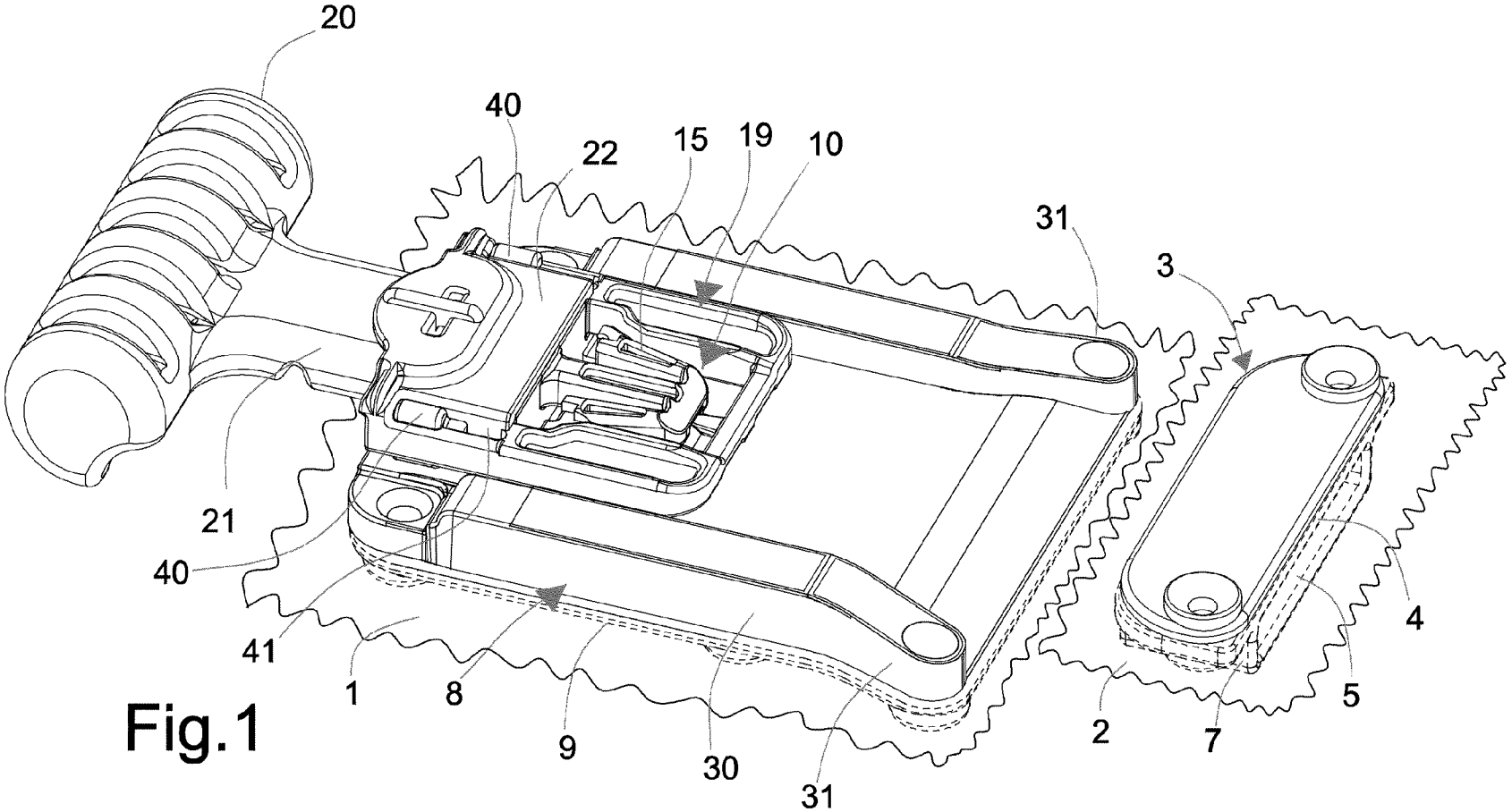
FIG. 1 is a perspective view of a device in accordance with an embodiment of the present disclosure in open condition.
Figure 2:
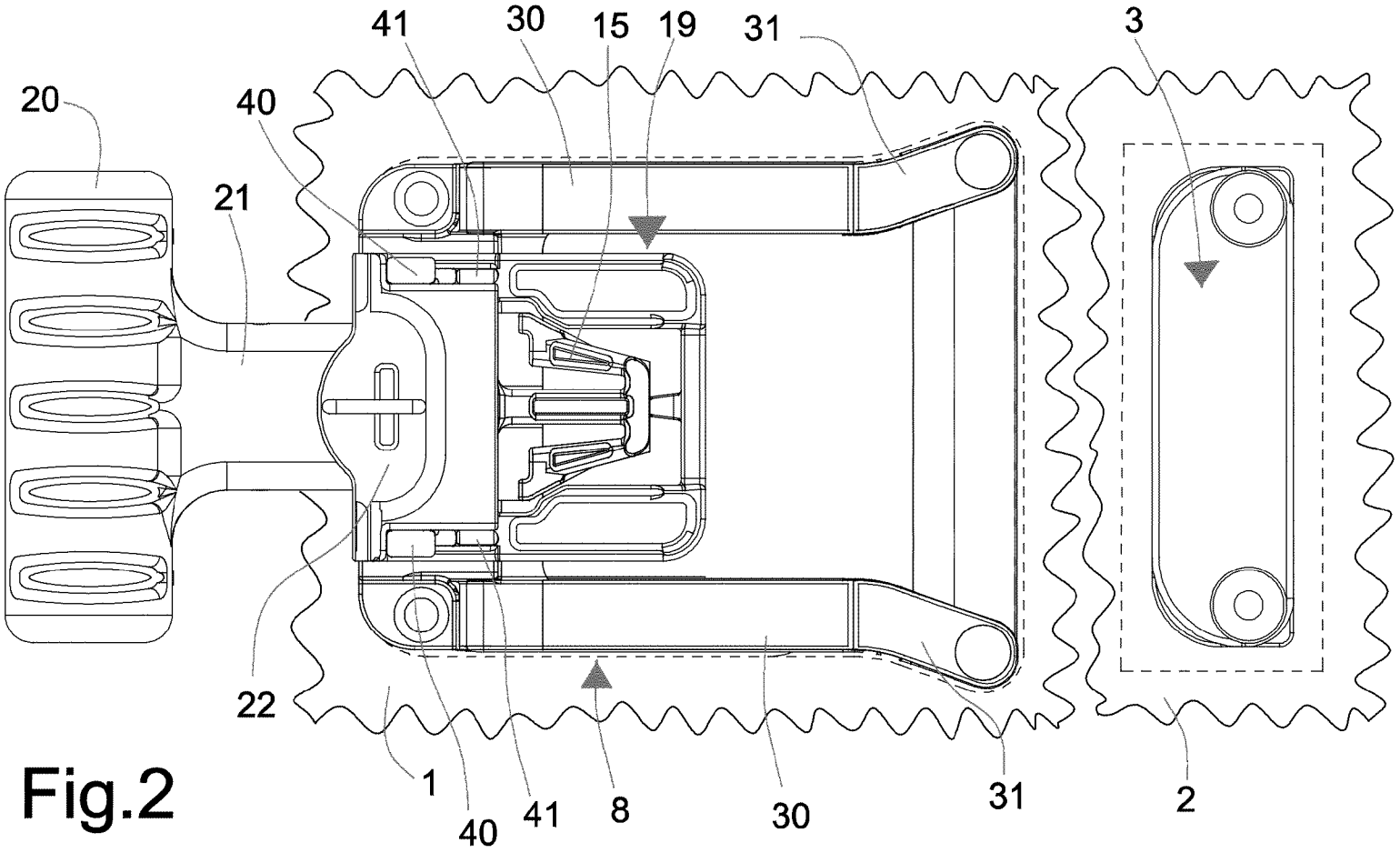
FIG. 2 is a plan view of the device of FIG. 1 in open condition.
Figure 3:
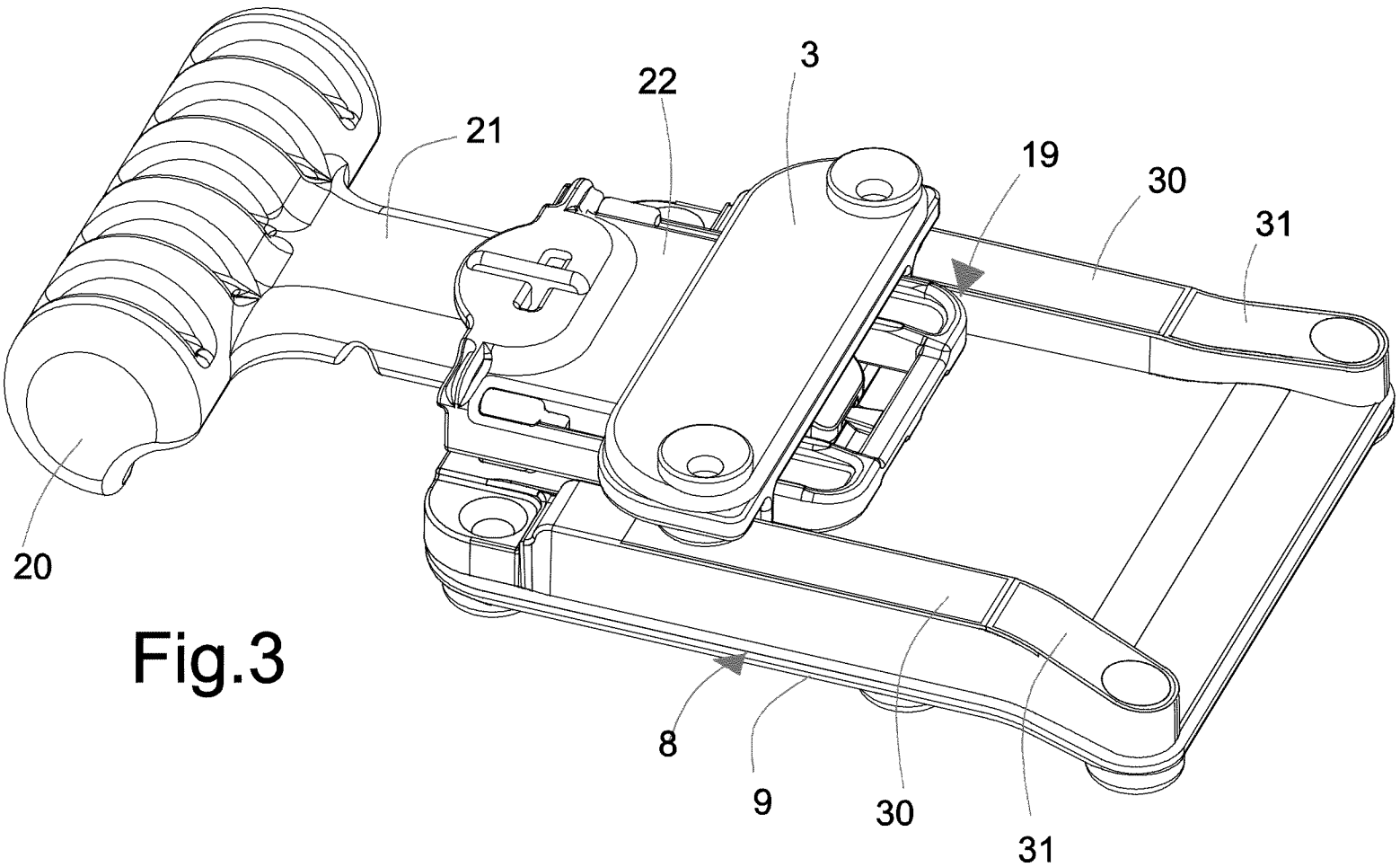
FIG. 3 is a perspective view of the device in closed condition.

With reference to the above mentioned figures, a wall of the casing (not shown in its entirety) containing the weights is indicated with 1, while an outer wall of the pocket of the jacket (also not shown in its entirety) is indicated with 2. Reference numeral 3 indicates a sheath, forming the female part of a buckle, fixed to the outer wall 2 of the pocket of the jacket. The sheath 3 can be made of rigid material and be tubular in shape with a relatively elongated substantially rectangular cross section. One of the larger walls of the sheath, indicated with 4, is fixed to the outer wall 2 of the pocket of the jacket so that the sheath 3 is inside the pocket. The second larger wall, indicated with 5, projects inside the pocket. Both walls 4 and 5 present teeth 6 intended to cooperate with corresponding transversal abutment surfaces formed in a male part 10 of the buckle. The smaller walls 7 of the tubular sheath 3 have a guiding function for such male part 10 of the buckle.

Figure 4:
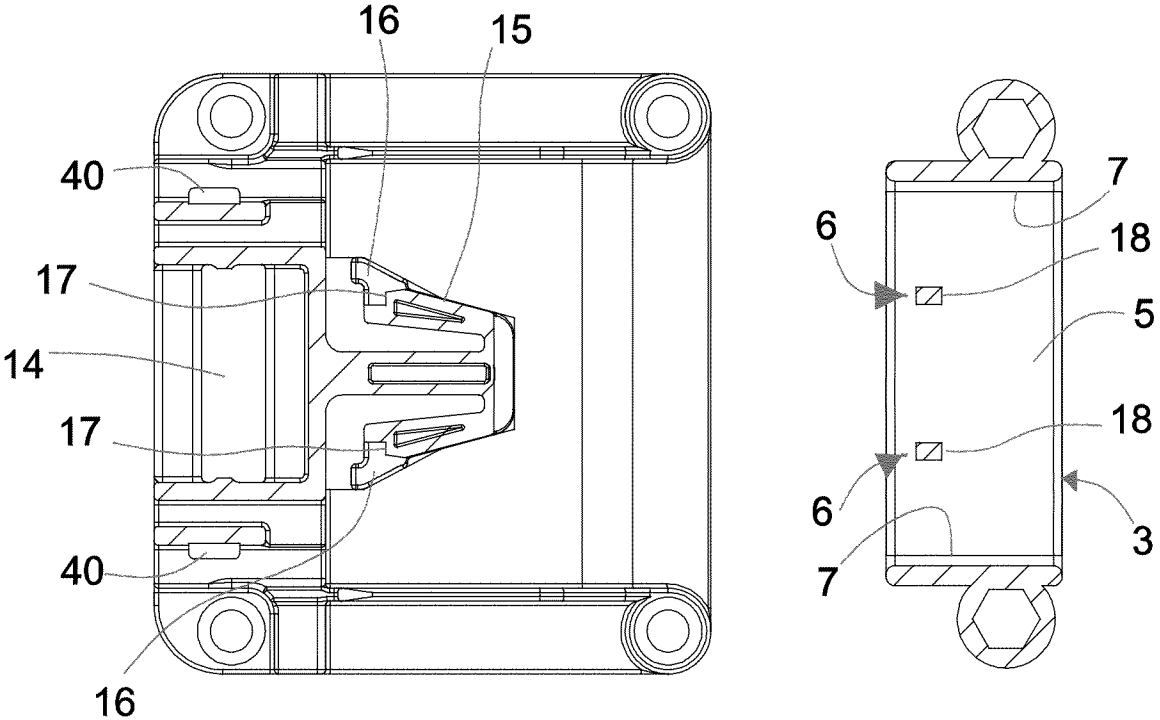
FIG. 4 is a partial view of the device according to FIG. 2, in which the auxiliary element of the male part has been removed and in which the sheath constituting the female part is shown in a sectional view parallel to the plane on which it lies.

The male part 10 of the buckle is fixed to the wall 1 of the casing through a rigid base plate 8 and a counter-plate 9 between which the wall 1 of the casing is interposed, analogously to what described in Italian patent No. 1,361,976 already mentioned above. Similarly to what described in European patent EP 1,864,586, also mentioned above, and as shown in FIG. 4, the male part 10 of the buckle has a first body 14, from which a pair of elastically deformable arms 15 project, such arms having inclined sides 16 and transversal abutment surfaces 17. The abutment surfaces 17 are intended to rest on abutment surfaces 18 of the teeth 6 projecting from the inner faces of the larger walls 4 and 5 of the sheath 3.

Figure 5:
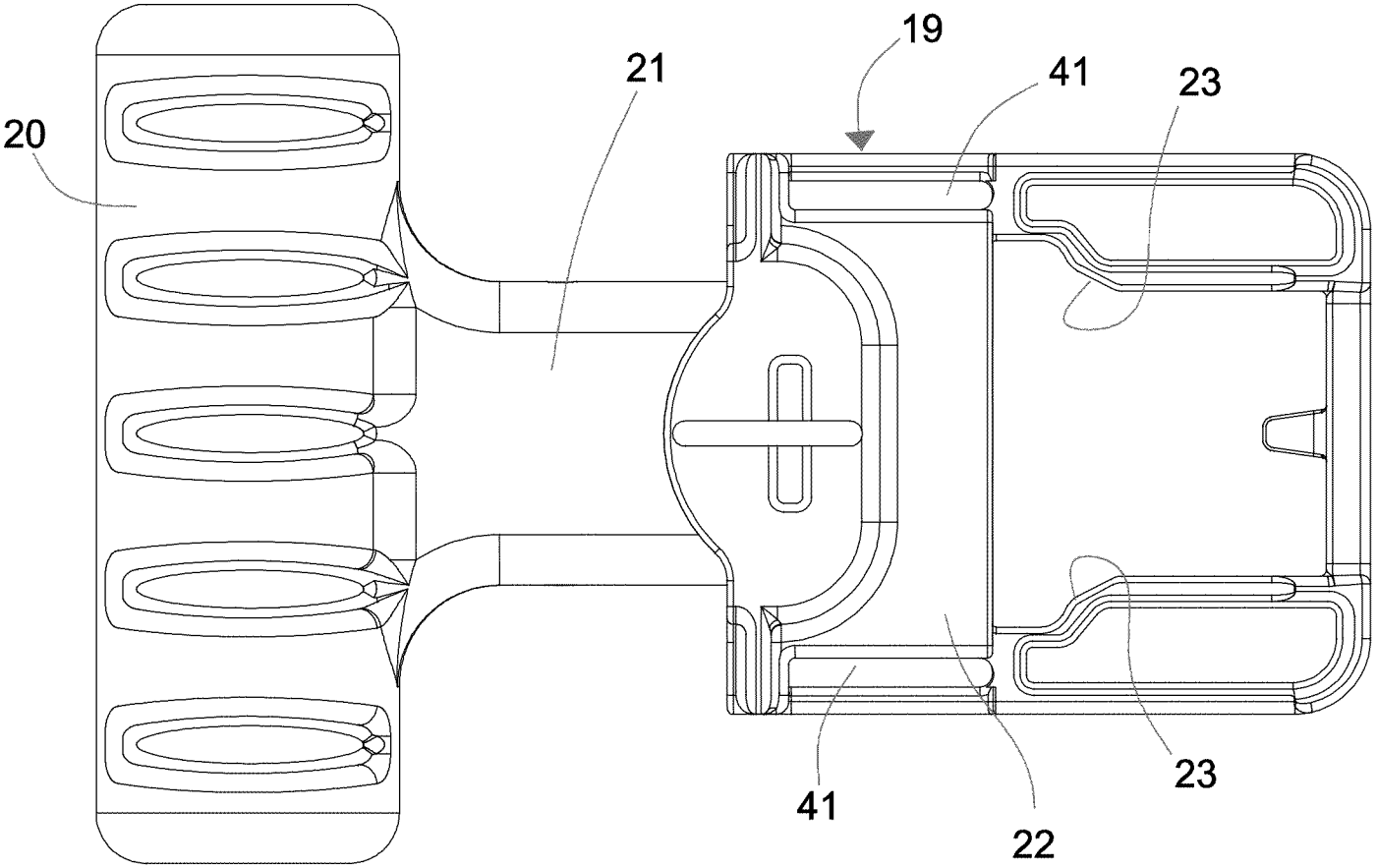
FIG. 5 is a partial view of the auxiliary element of the male part.

Also in accordance with the above mentioned European patent application EP 1,864,586 and as shown in FIG. 5, an auxiliary element 19 of the male part 10 of the buckle comprises a handgrip 20 that is connected, through an arm 21, to a plate 22 able to slide in contact with the rigid plate 8 and provided with inclined sides 23 intended to cooperate with the inclined sides 16 of the arms 15.

The connection between the male part 10 of the buckle and the auxiliary element 19 is made through a pair of teeth 40 rising from the first body 14 and slidably engaged in a corresponding pair of slots 41 formed on the plate 22 of the auxiliary element 19.

By pulling the handgrip 20, the inclined sides 23 of the plate 22 first of all slide against the inclined sides 16 of the arms 15, bending them inwards and, after suitable mutual sliding between said inclined sides, freeing the transversal abutment surfaces 17 from the transversal abutment surfaces 18 of the teeth 6 of the sheath 3. By continuing the pulling action on the handgrip 20, the entire male part 10 of the buckle can be withdrawn from the sheath 3 by extracting the casing of the weights from the pocket of the jacket.

The transversal abutments 17 of the flexible arms are freed from the transversal abutments 18 of the female part only at the end of such predetermined sliding. In this way, if accidental pulling on the handle does not complete the predetermined amount of relative sliding between male part and auxiliary element, the male part stays locked in the female part and the buckle does not open.

According to the present disclosure, the rigid plate 8 is equipped with lateral guide ribbings 30 that widen in their end part 31. In particular, the guide ribbings 30 are arranged a distance apart substantially equal to the distance between the smaller walls 7 of the sheath 3, so as to allow the sliding of said walls 7 inside said ribbings, and open out at their ends 31, to facilitate insertion of the sheath 3 between said guide ribbings 30 and thus insertion of the deformable arms 15 in the sheath 3 at the moment of closing of the buckle. In other words, the lateral guide ribbings 30 have splayed ends 31 on a side of the auxiliary element 19 that is opposite to a side from which the handgrip 20 extends.

In this way, with just one movement, the male part 10 of the buckle is inserted into the sheath 3 and the entry of the male part in the sheath is facilitated by the splayed end part 31 of the ribbings 30, which in the final position transversally lock the male part of the buckle to the sheath.

Therefore, in case the submerged diver wants to insert the casing of the weights back in the pocket of the jacket after extraction, he or she is helped in such insertion thanks to the presence of the guide ribbings for the rigid plate 8.

The examples set forth above are provided to give those of ordinary skill in the art a complete disclosure and description of how to make and use the embodiments of the device for reversible connection between a casing for weights and a corresponding pocket of a diving jacket of the disclosure, and are not intended to limit the scope of what the inventors regard as their disclosure. Modifications of the above-described modes for carrying out the disclosure can be used by persons of skill in the art, and are intended to be within the scope of the following claims.

All patents and publications mentioned in the specification are indicative of the levels of skill of those skilled in the art to which the disclosure pertains. All references cited in this disclosure are incorporated by reference to the same extent as if each reference had been incorporated by reference in its entirety individually.

It is to be understood that the disclosure is not limited to particular methods or systems, which can, of course, vary. It is also to be understood that the terminology used herein is for the purpose of describing particular embodiments only, and is not intended to be limiting. As used in this specification and the appended claims, the singular forms "a", "an", and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The invention claimed is:

1. A device for reversible connection between a casing for weights and a corresponding pocket of a diving jacket, comprising:

an elastically insertable and releasable buckle comprising:

a male part comprising elastically deformable arms, with transversal abutment surfaces and inclined sliding sides, a rigid plate connecting the male part to the casing, the rigid plate comprising lateral guide ribbings, a sheath acting as a female part of the buckle, the sheath comprising transversal abutment surfaces and being connected to the pocket of the diving jacket, wherein the lateral guide ribbings are suitable for insertion of the male part in the sheath, and an auxiliary element slidably engaged on the rigid plate, the auxiliary element being suitable for bending the deformable arms in order to release the transversal abutment surfaces of the deformable arms from the transversal abutment surfaces of the sheath, the auxiliary element comprising a handgrip rigidly connected to the auxiliary element, wherein the lateral guide ribbings of the male part of the buckle have splayed ends, on a side of said auxiliary element that is opposite to a side from which said handgrip extends.

2. The device according to claim 1, wherein the lateral guide ribbings of the male part, at their ends facing towards said handgrip, are a distance apart substantially equal to a width of the sheath so that, when the buckle is closed, relative transversal movements between the male part and the sheath of the buckle are prevented.

3. A device for reversible connection between a casing for weights and a corresponding pocket of a diving jacket, comprising:

an elastically insertable and releasable buckle comprising:

a male part comprising elastically deformable arms, with transversal abutment surfaces and inclined sliding sides, a rigid plate connecting the male part to the casing, the rigid plate comprising lateral guide ribbings, a sheath acting as a female part of the buckle, the sheath comprising transversal abutment surfaces and being connected to the pocket of the diving jacket, wherein the lateral guide ribbings are suitable for insertion of the male part in the sheath, and an auxiliary element slidably engaged on the rigid plate, the auxiliary element being suitable for bending the deformable arms in order to release the transversal abutment surfaces of the deformable arms from the transversal abutment surfaces of the sheath, the auxiliary element comprising a handgrip rigidly connected to the auxiliary element, wherein the handgrip comprises a rigid arm, the arm connecting the handgrip to the auxiliary element.

* * * * *